US010584004B2

(12) United States Patent
Okumura

(10) Patent No.: US 10,584,004 B2
(45) Date of Patent: Mar. 10, 2020

(54) SHEET CONVEYING APPARATUS

(71) Applicant: BROTHER KOGYO KABUSHIKI KAISHA, Nagoya-shi, Aichi-ken (JP)

(72) Inventor: Masayuki Okumura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/033,380

(22) Filed: Jul. 12, 2018

(65) Prior Publication Data

US 2019/0016548 A1 Jan. 17, 2019

(30) Foreign Application Priority Data

Jul. 13, 2017 (JP) ..... 2017-136839

(51) Int. Cl.

| | |
|---|---|
| ***B65H 1/14*** | (2006.01) |
| ***B65H 3/06*** | (2006.01) |
| ***B65H 5/06*** | (2006.01) |
| ***B65H 7/02*** | (2006.01) |

(52) U.S. Cl.

CPC ..... *B65H 1/14* (2013.01); *B65H 3/0607* (2013.01); *B65H 3/0638* (2013.01); *B65H 3/0661* (2013.01); *B65H 3/0669* (2013.01); *B65H 3/0684* (2013.01); *B65H 5/064* (2013.01); *B65H 7/02* (2013.01); *B65H 2511/152* (2013.01); *B65H 2511/214* (2013.01); *B65H 2511/30* (2013.01); *B65H 2511/515* (2013.01); *B65H 2553/612* (2013.01); *B65H 2801/12* (2013.01)

(58) Field of Classification Search

CPC ..... B65H 1/14; B65H 3/0607; B65H 3/0661; B65H 7/02; B65H 2511/152; B65H 3/0684

USPC ..... 271/127, 118, 117, 152

See application file for complete search history.

(56) References Cited

U.S. PATENT DOCUMENTS 8,690,150 B2 * 4/2014 Obara ..... B65H 1/266 271/117

FOREIGN PATENT DOCUMENTS

| | | |
|---|---|---|
| JP | 2002-87619 A | 3/2002 |
| JP | 2003-12171 A | 1/2003 |

* cited by examiner

*Primary Examiner* — David H Bollinger

(74) *Attorney, Agent, or Firm* — Merchant & Gould P.C.

(57) ABSTRACT

A sheet conveying apparatus, including: a sheet storage portion; a roller to convey sheets by rotating about a rotation axis; an arm rotatably supporting the roller and pivotable about an arm pivot axis; a presser plate pivotable about a presser-plate pivot axis; and a pivot mechanism to pivot the presser plate such that a contact angle, which is an angle defined upstream in a sheet conveyance direction by the arm and an uppermost one of the sheets contacting the roller, is less than a maximum angle in a time period from a sheet maximally loaded state to a sheet minimally loaded state, the maximum angle being an angle defined upstream in the conveyance direction by: only one sheet assumed to be placed on the presser plate which is the presser plate in the maximally loaded state; and the arm the roller of which contacts the one sheet.

7 Claims, 5 Drawing Sheets

SHEET CONVEYING APPARATUS

CROSS REFERENCE TO RELATED APPLICATION

The present application claims priority from Japanese Patent Application No. 2017-136839, which was filed on Jul. 13, 2017, the disclosure of which is herein incorporated by reference in its entirety.

BACKGROUND

Technical Field

The following disclosure relates to a sheet conveying apparatus configured to convey sheets such as paper.

Description of Related Art

There is known an apparatus configured to convey sheets stored in a sheet supply tray by rotating a first supply roller (roller) supported at a distal end of a pivotable arm while the roller is held in contact with a surface of an uppermost one of the sheets stored in the sheet supply tray, so that the uppermost sheet is conveyed.

SUMMARY

In the known apparatus, an angle defined on an upstream side in a sheet conveyance direction by the arm and the sheets stored in the sheet supply tray, namely, a contact angle, changes in a time period from a fully loaded state in which a maximal amount of the sheets are loaded on the sheet supply tray to a near empty state in which one sheet is loaded on the sheet supply tray. Specifically, the contact angle increases with a decrease in the amount of the sheets loaded on the sheet supply tray. As a result, a pressing force applied by the roller to the sheets becomes large, so that a plurality of sheets are likely to be conveyed in an overlapping state, namely, multiple feeding of the sheets tends to occur.

Accordingly, one aspect of the present disclosure relates to a sheet conveying apparatus capable of preventing or reducing an occurrence of multiple feeding of the sheets in a time period from the fully loaded state to the near empty state.

One aspect of the present disclosure provides a sheet conveying apparatus, including: a storage portion for storing a stack of a plurality of sheets; a roller rotatable about a rotation axis parallel to the plurality of sheets stored in the storage portion and configured to convey the plurality of sheets in a conveyance direction by rotating about the rotation axis while being held in contact with a surface of an uppermost one of the plurality of sheets stored in the storage portion; an arm rotatably supporting the roller, the arm being pivotable about an arm pivot axis parallel to the rotation axis with the roller located downstream of the arm pivot axis in the conveyance direction; a presser plate pivotable about a presser-plate pivot axis parallel to the rotation axis and configured to press the plurality of sheets stored in the storage portion toward the roller, the presser-plate pivot axis being located downstream, in the conveyance direction, of the rotation axis of the roller in a maximally loaded state in which a maximal amount of the plurality of sheets are loaded on the storage portion; and a pivot mechanism configured to pivot the presser plate about the presser-plate pivot axis, wherein the pivot mechanism is configured to pivot the presser plate such that a contact angle, which is an angle defined upstream in the conveyance direction by the arm and an uppermost one of the plurality of sheets that is held in contact with the roller, is less than a maximum angle in a time period from the maximally loaded state to a minimally loaded state in which a minimal amount of the plurality of sheets are loaded on the storage portion, the maximum angle being an angle defined upstream in the conveyance direction by: only one sheet assumed to be placed on the presser plate which is the presser plate in the maximally loaded state; and the arm the roller of which contacts the one sheet.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

Figure 1:
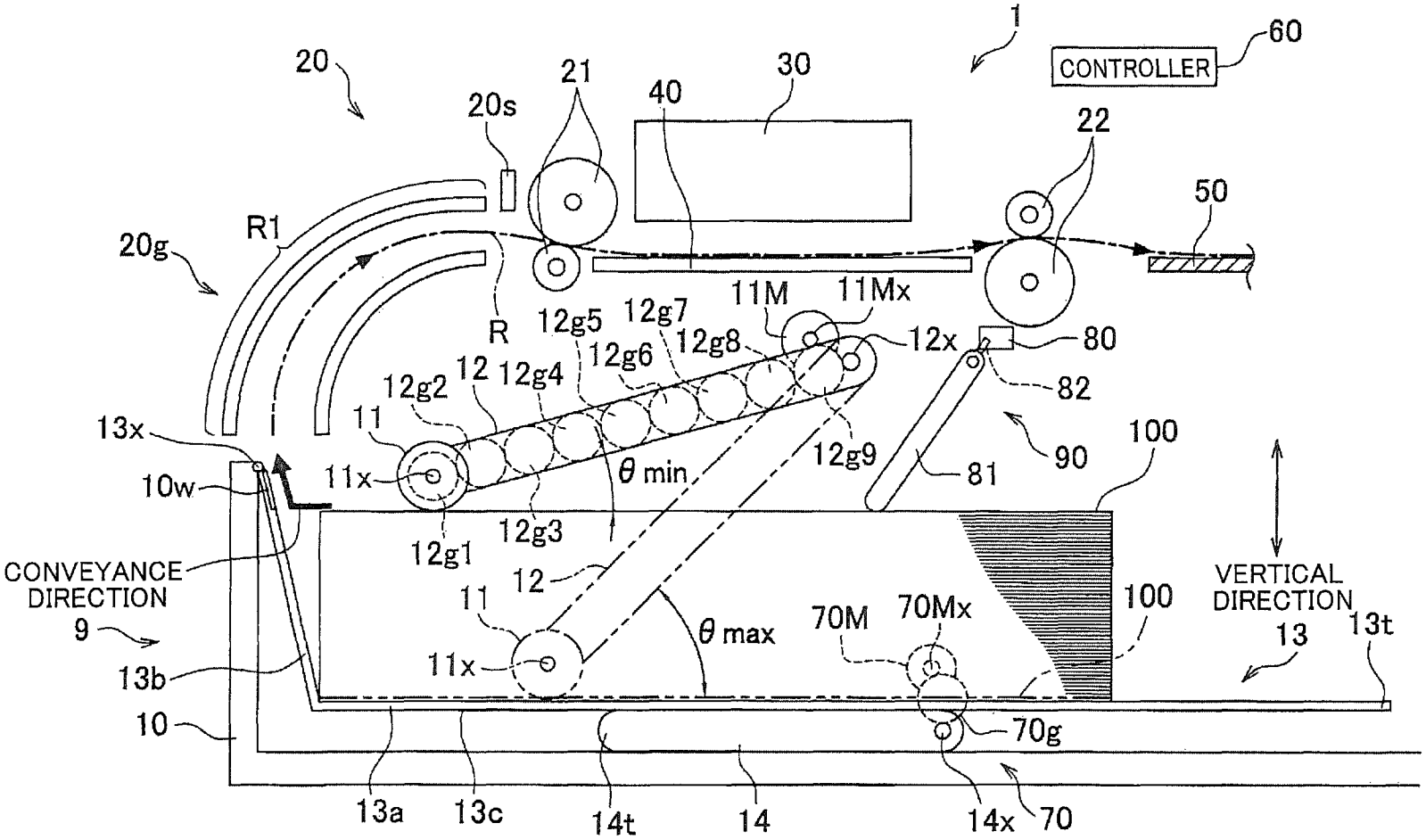
FIG. 1 is a schematic side view showing an inner structure of a printer according to one embodiment.

There will be hereinafter explained a printer according to one embodiment. As shown in FIG. 1, the printer (as one example of a sheet conveying apparatus) 1 includes a sheet supplier 9 capable of storing a stack of a plurality of sheets 100, a sheet conveyor 20 configured to convey an uppermost one of the plurality of sheets 100 stored in the sheet supplier 9 along a conveyance path R, a recording portion 30 configured to perform recording on the sheet 100 conveyed by the sheet conveyor 20, a platen 40 which is opposed to the recording portion 30, an output tray 50 for receiving the sheet 100 which has been conveyed by the sheet conveyor 20, and a controller 60 configured to control the sheet supplier 9, the sheet conveyor 20, the recording portion 30, and other devices.

The sheet conveyor 20 includes: a roller 11 disposed so as to be in contact with an uppermost one of the plurality of sheets 100 stored in the sheet supplier 9; a roller pair 21 disposed upstream of the recording portion 30 in the conveyance path R; a roller pair 22 disposed downstream of the recording portion 30 in the conveyance path R; and guide plates 20*g* that partially define the conveyance path R. A distance between the roller 11 and the roller pair 21 along the conveyance path R is not greater than a length, in the conveyance direction, of the sheet 100 conveyed from the sheet supplier 9. That is, the sheet 100 is conveyed from the sheet supplier 9 to the roller pair 21 by the roller 11. As shown in FIG. 1, the guide plates 20*g* are disposed close to a separation wall 10*w* along the conveyance direction and define, in the conveyance path R, a curved path R1 that curves rightward as extending upward. The curved path R1 is a high resistance portion at which a relatively large resistance to conveyance is generated to the sheet 100 that is passing through the conveyance path R.

A sheet sensor (as one example of a sheet detecting sensor) 20*s* is disposed between the guide plates 20*g* and the roller pair 21. The sheet sensor 20*s* is configured to detect a leading end of the sheet 100 conveyed by the roller 11. In response to detection of the leading end of the sheet 100, the sheet sensor 20*s* outputs a detection signal to the controller 60. It is possible to detect, by the sheet sensor 20*s*, whether the leading end of the sheet 100 has passed the guide plates 20*g* that constitute the high resistance portion described above. That is, it is possible to determine by the controller 60 whether the sheet 100 is suffering from a conveyance failure due to a slippage of the roller 11 with respect to the sheet 100 as a result of a high conveyance load applied to the sheet 100 when the sheet 100 conveyed by the roller 11 is passing through the curved path R1.

The roller 11 has a rotation shaft 11*x* parallel to the sheets 100 stored in the sheet supplier 9. The roller 11 is pressed onto and is contacted with a surface of an uppermost one of the plurality of sheets 100 stored in the sheet supplier 9, specifically, in a sheet supply tray 10 which will be described. The roller 11 rotates about the rotation shaft 11*x* while being in contact with the surface of the uppermost sheet 100, so as to convey the sheet 100 in the conveyance direction.

The rotation shaft 11*x* of the roller 11 is rotatably supported by a distal end of the arm 12. The arm 12 is pivotable about a pivot shaft 12*x* provided at a basal end of the arm opposite to the distal end thereof with the roller 11 kept located downstream of the pivot shaft 12*x* in the conveyance direction. The pivot shaft 12*x* is parallel to the rotation shaft 11*x* and is rotatably supported by a housing (not shown) of the printer 1.

The arm 12 supports gears 12*g*1-12*g*9. The gears 12*g*1-12*g*9 are in mesh with one another. The gear 12*g*1 is fixed to the rotation shaft 11*x*, the gear 12*g*9 is in mesh with a shaft 11Mx of a drive motor 11M, and the gears 12*g*2-12*g*8 connect the gear 12*g*1 and the gear 12*g*9. When the drive motor 11M is driven, the gears 12*g*1-12*g*9 are rotated, so that a drive force of the drive motor 11M is transmitted to the roller 11, and the roller 11 is rotated. Thus, the sheet 100 is conveyed from the sheet supplier 9.

The sheet supplier 9 includes the sheet supply tray (as one example of a storage portion) 10 shaped like a box and capable of storing a stack of the plurality of sheets 100, a pivot mechanism 70, and a sheet detecting mechanism (as one example of a sheet detecting mechanism) 90 configured to detect a decrease of the sheets 100. The sheet supply tray 10 pivotally supports a presser plate 13 for pressing the sheets 100 stored in the sheet supply tray 10 toward the roller 11. As shown in FIG. 1, the presser plate 13 includes: a horizontal portion 13*a* (as one example of a support surface) that extends horizontally in a fully loaded state (as one example of a maximally loaded state) in which a maximal amount of the sheets 100 are loaded on the sheet supply tray 10; and an inclined portion 13*b* that extends obliquely upward from a downstream end portion of the horizontal portion 13*a* in the conveyance direction. The horizontal portion 13*a* and the inclined portion 13*b* intersect each other. At an upper end of the inclined portion 13*b*, there is provided a pivot shaft 13*x* about which the presser plate 13 pivots. The presser plate 13 in the present embodiment includes the horizontal portion 13*a* having a size that permits the horizontal portion 13*a* to overlap, as viewed in the up-down direction, an entirety of the sheets 100 storable in the sheet supply tray 10 (an entirety of the sheets 100 of the largest size storable in the sheet supply tray 10), so as to support the entirety of the sheets 100 from below. It is, however, noted that the horizontal portion 13*a* may be configured to extend from the pivot shaft 13*x* at least to a position where the horizontal portion 13*a* overlaps, in the vertical direction, the center of gravity of the sheets 100. Such a configuration also enables the presser plate 13 to press the sheets 100 toward the roller 11.

As shown in FIG. 1, the pivot mechanism 70 includes a push-up member 14 for pushing up the presser plate 13 from below so as to pivot the presser plate 13, a gear 70*g*, and a pivotal-movement motor 70M. The pivot shaft 13*x* of the presser plate 13 and a pivot shaft 14*x* of the push-up member 14 are parallel to the rotation shaft 11*x* and rotatably supported by the sheet supply tray 10. The presser plate 13 is pivotable about the pivot shaft 13*x* while its upstream end portion 13*t* in the conveyance direction is kept located upstream of the pivot shaft 13*x* in the conveyance direction.

Figure 2:
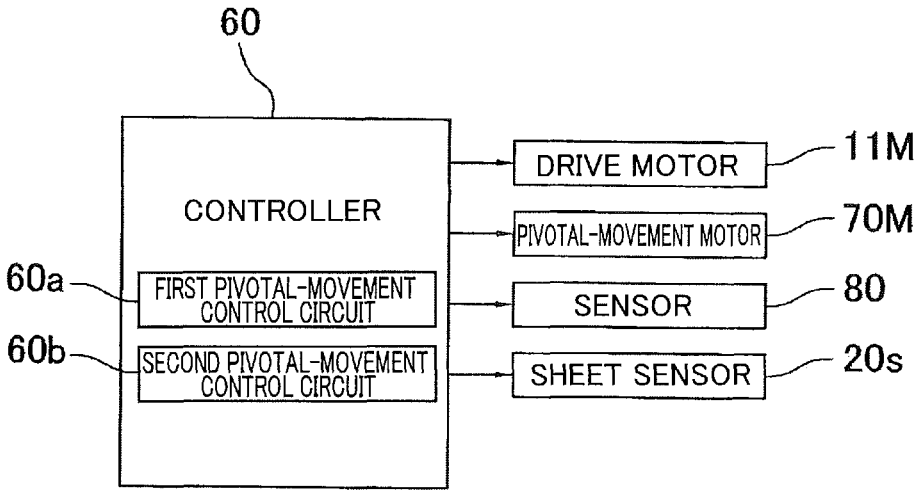
FIG. 2 is a block diagram of a controller shown in FIG. 1.

The push-up member 14 is pivotable about the pivot shaft 14*x* while its downstream end portion 14*t* in the conveyance direction is kept located downstream of the pivot shaft 14*x* in the conveyance direction. The push-up member 14 is configured to push up the presser plate 13 and supports the presser plate 13 while the downstream end portion 14*t* of the push-up member 14 is in contact with a portion of a lower surface 13*c* of the presser plate 13 (that is opposite to a surface thereof facing the roller 11), which portion is located upstream in the conveyance direction of the rotation shaft 11*x* of the roller 11 in a near empty state indicated by the long dashed double-short dashed line in FIG. 1, i.e., in a state in which one sheet 100 is placed on the sheet supply tray 10. The gear 70*g* is in mesh with the shaft 70Mx of the pivotal-movement motor 70M and the pivot shaft 14*x* of the push-up member 14. When the pivotal-movement motor 70M is driven, a drive force of the pivotal-movement motor 70M is transmitted to the pivot shaft 14*x*, so that the push-up member 14 pivots. As shown in FIG. 2, the controller 60 drives the pivotal-movement motor 70M based on a signal from the sensor 80 and a signal from the sheet sensor 20*s*, so that the push-up member 14 is pivoted about the pivot shaft 14*x*, and the presser plate 13 is accordingly pivoted about the pivot shaft 13*x*. That is, the controller 60 controls a posture of the push-up member 14 and accordingly a posture of the presser plate 13. The push-up member 14 is pivoted clockwise so as to push up the presser plate 13, so that the presser plate 13 takes a posture in which the upstream end portion 13*t* of the horizontal portion 13*a* is located at a height level higher than the downstream end portion of the horizontal portion 13*a*, namely, a posture in which the horizontal portion 13*a* is inclined with respect to the horizontal plane.

The separation wall 10*w* is formed integrally with the presser plate 13. Specifically, the separation wall 10*w* is disposed at an upper portion of the inclined portion 13*b* of the presser plate 13, i.e., a portion of the presser plate 13 located downstream of the roller 11 in the conveyance direction, and below the pivot shaft 13*x*. In other words, the pivot shaft 13*x* is disposed at a height level equal to or higher than a height level of an upper end of the separation wall 10*w*. In the case where the sheets 100 are fed at one time in an overlapping state by rotation of the roller 11, the separation wall 10*w* contacts one of the sheets 100 that is farthest from the roller 11 and gives the farthest sheet 100 a resistance to conveyance, so as to separate the uppermost sheet 100 contacting the roller 11 from other sheets fed together with the uppermost sheet 100. The conveyance resistance received by the sheet 100 at the separation wall 10*w* is smaller than the conveyance resistance received at the curved path R1. To effectuate the sheet separating function, the separation wall 10*w* is provided with a separation member (not shown), for instance. For instance, the separation member may be a plate member formed of a material having a high frictional resistance, such as cork or rubber, or may be a member having a plurality of protrusions formed of resin or metal.

The sheet detecting mechanism 90 includes the sensor 80 and a rod member 81. The rod member 81 is supported by the housing of the printer 1 so as to be rotatable about its upper end portion. The sensor 80 includes a detector (not shown) constituted by a light emitting portion and a light receiving portion which receives a light emitted from the light emitting portion. The sensor 80 is disposed such that the sensor 80 can detect a protrusion 82 formed at the upper end portion of the rod member 81. The rod member 81 is disposed such that its distal end portion (lower end portion) is contactable with the surface of the uppermost sheet 100. The rod member 81 is configured to pivot in accordance with a decrease of the sheets 100.

Figure 4A:
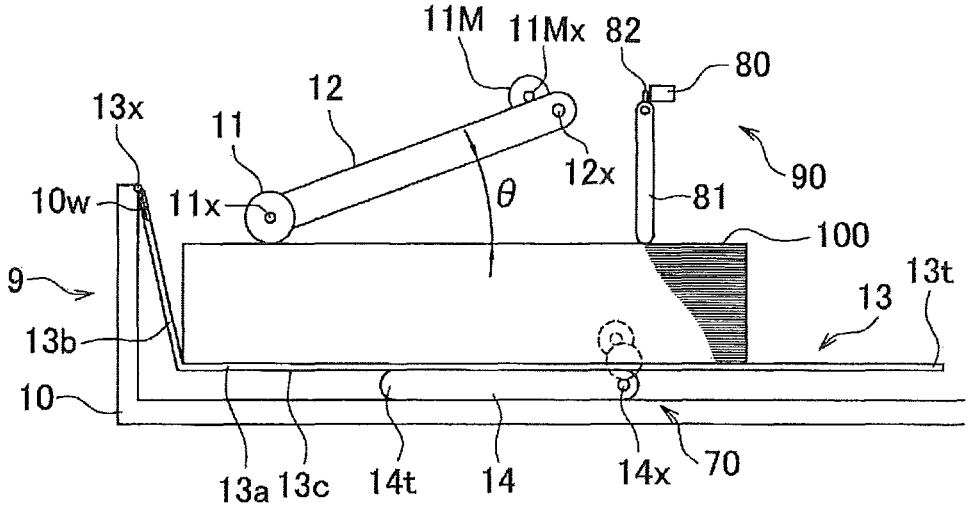
FIGS. 4A and 4B are views for explaining operations of a presser plate, an arm, a rod member, and a pivot mechanism when an amount of sheets is decreased in accordance with a recording operation of a printer of FIG. 1, FIG. 4A being a view showing a situation in which a predetermined amount of the sheets is decreased from the fully loaded state, FIG. 4B being a view showing a situation in which the contact angle of the roller is changed from that in the state of FIG. 4A so as to become equal to the contact angle of the roller in the fully loaded state.

The sensor 80 detects a presence or an absence of the protrusion 82 in conjunction with a pivotal movement of the rod member 81 and outputs a signal to the controller 60. That is, when the rod member 81 pivots in accordance with a decrease of the sheets 100 such that its posture changes from a state shown in FIG. 1 to a state shown in FIG. 4A, the protrusion 82 of the rod member 81 moves outside a detection range of the detector of the sensor 80, so that the sensor 80 outputs, to the controller 60, a signal indicative of an absence of the protrusion 82, namely, indicative of non-detection of the protrusion 82. In response to reception of the signal indicative of the absence of the protrusion 82 from the sensor 80, the controller 60, specifically, a first pivotal-movement control circuit 60*a* (which will be explained), drives the pivotal-movement motor 70M, so as to pivot the presser plate 13 counterclockwise in FIG. 1. More specifically, the first pivotal-movement control circuit 60*a* controls the pivotal-movement motor 70M so as to pivot the push-up member 14 in accordance with an angle which is stored in a ROM of the controller 60 in association with the signal from the sensor 80 indicative of the absence of the protrusion 82. The ROM of the controller 60 stores a plurality of angles associated in order with the signals indicative of the absence of the protrusion 82 which are output from the sensor 80 in a time period from the fully loaded state to the empty state. That is, the ROM stores an angle associated with a signal output from the sensor 80 when the amount of the sheets is decreased from the amount in the fully loaded state shown in FIG. 1 to the amount in the state shown in FIG. 4A and a plurality of angles associated with signals subsequently output from the sensor 80 in accordance with a decrease of the sheets 100 thereafter. The first pivotal-movement control circuit 60*a* controls the pivotal-movement motor 70M such that the push-up member 14 pivots by the angle associated with the signal output from the sensor 80. The plurality of angles stored in the ROM are angles each of which causes an angle defined upstream in the conveyance direction by the arm 12 and the uppermost one of the sheets 100 on the presser plate 13 that is in contact with the roller 11 to become equal to a minimum angle θ min (which will be explained) as a result of the pivotal movement of the push-up member 14. Further, the plurality of angles stored in the ROM are angles by which the rod member 81 pivots in its pivotal movement from the state shown in FIG. 4A to the state shown in FIG. 1. In this way, each time the signal indicative of the absence of the protrusion 82 is output from the sensor 80, the presser plate 13 pivots counterclockwise such that the angle defined upstream in the conveyance direction by the arm 12 and the uppermost one of the sheets 100 placed on the presser plate 13 that is in contact with the roller 11 becomes equal to the minimum angle θ min. It is noted that the rod member 81 is not disposed beyond above a position at which the rod member 81 contacts the sheet 100 that is located uppermost in the fully loaded state. In other words, the position at which the rod member 81 contacts the sheet 100 that is located uppermost in the fully loaded state is an upper limit position of the rod member 81.

Figure 3:
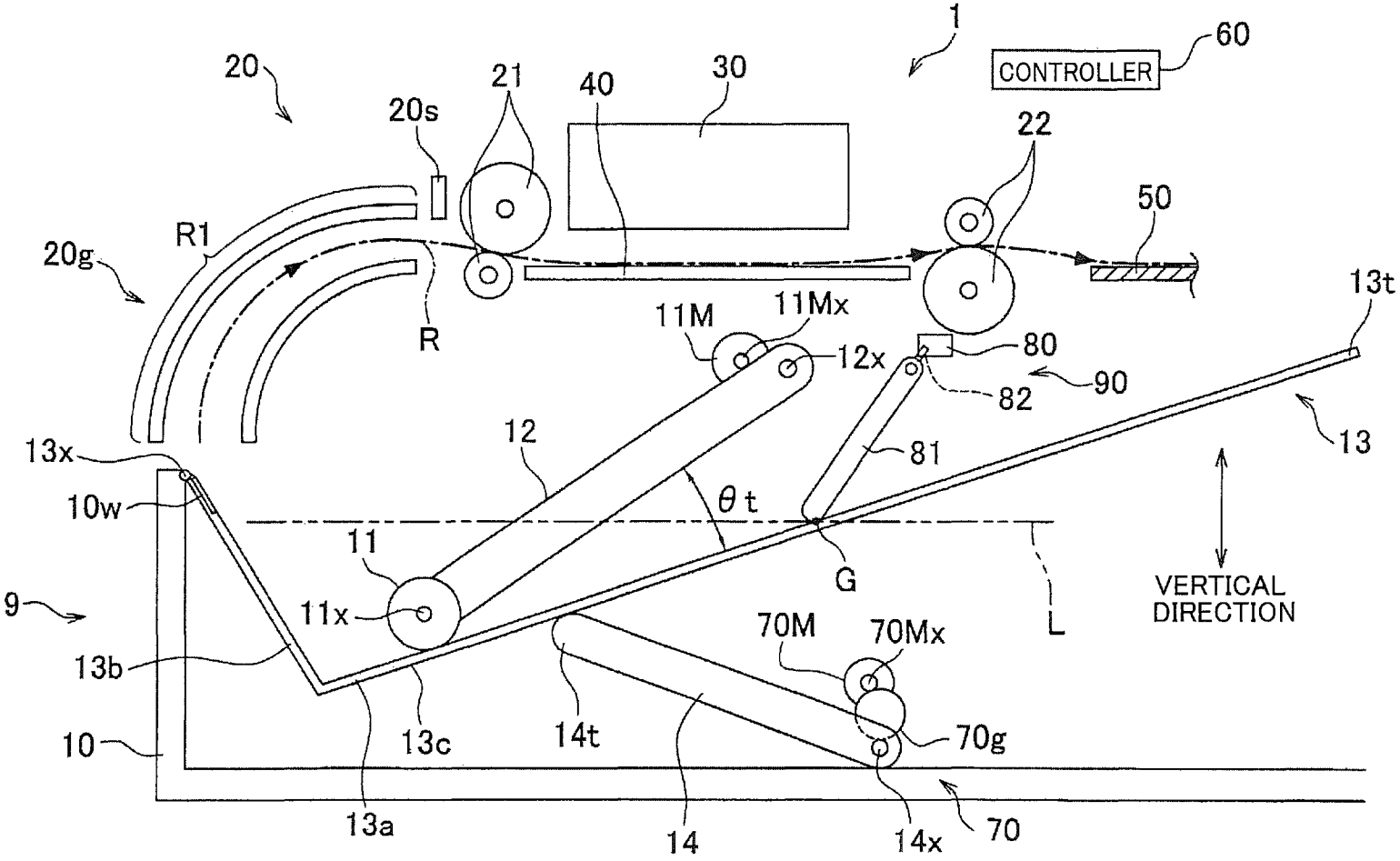
FIG. 3 is a view showing a situation in which a contact angle of a roller defined when the roller contacts the presser plate in an empty state is the same as a contact angle of the roller in a fully loaded state.

FIG. 3 shows a situation in which a contact angle θ of the roller 11 in the case where the roller 11 contacts the presser plate 13 in the empty state is the same as a contact angle θ of the roller 11 in the fully loaded state. As shown in FIG. 3, the rod member 81 is disposed such that the distal end portion (lower end portion) thereof is contactable with an intersection point G. The intersection point G is a point of intersection of: the presser plate 13 in a state in which an angle θt, which is defined upstream in the conveyance direction by the arm 12 and the presser plate 13 when the roller 11 contacts the presser plate 13 in the empty state in which no sheets 100 are loaded on the sheet supply tray 10, is the same as the contact angle θ of the roller 11 in the fully loaded state; and a virtual line L that indicates a height level of the uppermost sheet 100 contacting the roller 11 in the fully loaded state. In the present embodiment, the contact angle θ of the roller 11 means an acute angle defined, in a state in which the roller 11 is in contact with the sheet 100, by the sheet 100 in question and the arm 12. That is, the contact angle θ of the roller 11 is an angle defined upstream in the conveyance direction by the arm 12 and the sheet 100 contacting the roller 11. It is noted that the contact angle θ of the roller 11 is the smallest in the fully loaded state, i.e., the minimum angle θ min. The rod member 81 is disposed so as to be contactable with the uppermost one of the sheets 100 stored in the sheet supply tray 10 on an upstream side of the intersection point G in the conveyance direction, thereby enabling the decrease of the sheets 100 to be detected.

As described above, the sheet detecting mechanism 90 is configured to detect the decrease of the sheets 100 stored in the sheet supply tray 10 on the upstream side of the intersection point G in the conveyance direction, so that the presser plate 13 does not pivot counterclockwise in FIG. 3 any more from the posture of the presser plate 13 shown in FIG. 3. Thus, the position in the vertical direction of the upstream end of the presser plate 13 in the conveyance direction can be made relatively low. That is, the upstream end of the presser plate 13 in the conveyance direction is not raised too much, so that the height of the printer 1 can be made small.

As a modification, the rod member 81 may be configured to be contactable with, namely, detectable, a trailing end, in the conveyance direction, of the sheet 100 of the smallest size stored in the sheet supply tray 10. In short, the rod member 81 may be configured to detect the decrease of the sheets at any position between the intersection point G and the trailing end of the sheet 100 of the smallest size in the conveyance direction.

The controller 60 includes a central processing unit (CPU), the read only memory (ROM), a random access memory (RAM), and an application specific integrated circuit (ASIC), which cooperate to control operations of devices such as the sheet supplier 9 (including the pivotal-movement motor 70M), the sheet conveyor 20 (including the drive motor 11M), and the recording portion 30. For instance, the controller 60 controls the sheet supplier 9, the sheet conveyor 20, the recording portion 30, and other devices based on a recording instruction sent from a personal computer (PC) to perform a recording operation to record an image or the like on the sheet 100. The controller 60 further includes the first pivotal-movement control circuit 60*a* and a second pivotal-movement control circuit 60*b*. The first pivotal-movement control circuit 60*a* controls the pivotal-movement motor 70M when received from the sensor 80 the signal indicative of the absence of the protrusion 82, such that the push-up member 14 pivots by one of the angles stored in the ROM of the controller 60 and associated with the signal output from the sensor 80 indicative of the absence of the protrusion 82. The second pivotal-movement control circuit 60*b* determines that a conveyance failure is occurring when a signal indicative of detection of the leading end of the sheet 100 is not output from the sheet sensor 20*s* even when a predetermined time elapses after a time point of starting of conveyance of the sheet 100. In this case, the second pivotal-movement control circuit 60*b* controls the pivotal-movement motor 70M such that the contact angle θ of the roller 11 is slightly larger before next conveyance is started. The ROM stores the plurality of angles described above.

Referring next to FIGS. 1, 4, and 5, there will be explained operations of the presser plate 13 and the push-up member 14 in a time period in which a state of the sheet supply tray 10 changes from the fully loaded state (in which a maximal amount of the sheets 100 are loaded on the sheet supply tray 10) to the near empty state (in which one sheet 100 is loaded on the sheet supply tray 10) by performing the recording operation. As explained below, the contact angle θ of the roller 11 is kept at an angle not less than the minimum angle θ min and less than a maximum angle θ max in the time period from the fully loaded state to the near empty state.

In response to reception of a recording instruction, the controller 60 drives the drive motor 11M such that the roller 11 conveys the sheet 100 in the conveyance direction. In the fully loaded state, the contact angle θ of the roller 11 is equal to the minimum angle θ min, as shown in FIG. 1. Though the pressing force of the roller 11 with respect to the sheet 100 is the smallest at the angle θ min, the angle θ min falls within a permissible range in which is generated the pressing force that prevents an occurrence of a feeding failure (i.e., a phenomenon in which the sheet 100 cannot be conveyed due to a slippage between the roller 11 and the sheet 100 even when the roller 11 is rotated). In this respect, the contact angle θ of the roller 11 smaller than the angle θ min is likely to cause the feeding failure. Even when the sheets 100 are conveyed from the sheet supply tray 10 at one time in an overlapping state, namely, even when the multiple feeding of the sheets occurs, the separation wall 10*w* separates the sheet 100 contacting the roller 11 from other sheets 100. Thus, conveyance of one sheet 100 separated by the separation wall 10*w* and contacting the roller 11 is started. Subsequently when the leading end of the sheet 100 in question is detected by the sheet sensor 20*s*, the controller 60 controls a drive motor (not shown) of the roller pairs 21, 22 of the sheet conveyor 20, the recording portion 30, and other devices, so that an image is recorded on the sheet 100 and the sheet 100 is then discharged to the output tray 50. Thus, the recording operation is ended.

Figure 4B:
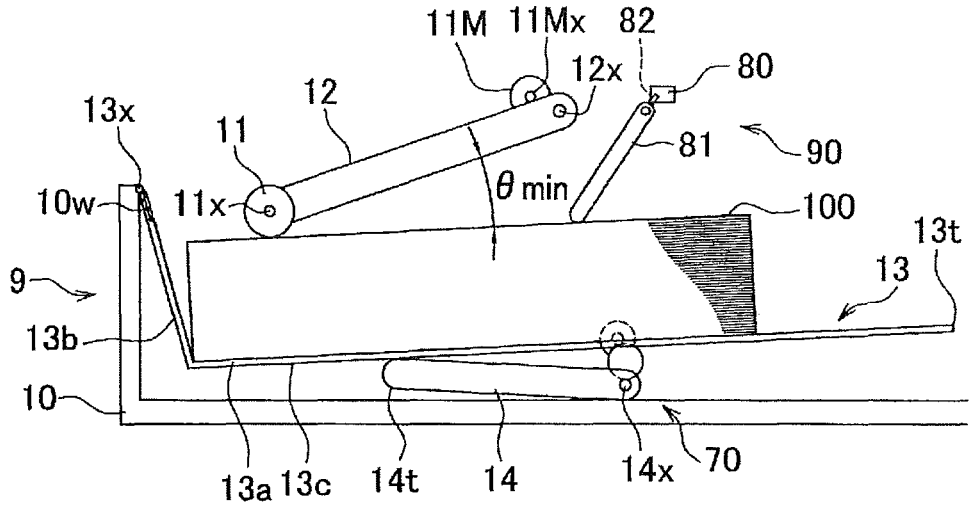

As the recording operation is repeatedly performed, the sheets 100 in the sheet supply tray 10 are decreased. Every time one of the sheets 100 is used, the roller 11 moves downward. That is, the arm 12 pivots counterclockwise in FIG. 1 such that the contact angle θ of the roller 11 becomes larger than the angle θ min. In this instance, the rod member 81 similarly pivots counterclockwise. When the sheets 100 are further decreased, the protrusion 82 of the rod member 81 moves outside the detection range of the detector of the sensor 80 as shown in FIG. 4, and the sensor 80 outputs, to the controller 60, the signal indicative of the absence of the protrusion 82. In this instance, the contact angle θ of the roller 11 is larger than the minimum angle θ min but smaller than the maximum angle θ max. As shown in FIG. 1, the maximum angle θ max is an angle defined upstream in the conveyance direction by: only one sheet (indicated by the long dashed double-short dashed line in FIG. 1) assumed to be placed on the presser plate 13 which is the presser plate 13 in the fully loaded state; and the arm 12 the roller 11 of which contacts the one sheet. Based on the signal from the sensor 80 indicative of the absence of the protrusion 82, the first pivotal-movement control circuit 60*a* of the controller 60 drives the pivotal-movement motor 70M such that the contact angle θ of the roller 11 becomes equal to θ min as shown in FIG. 4B, so as to control the postures of the push-up member 14 and the presser plate 13. The control causes the protrusion 82 of the rod member 81 to be located at a position detectable by the sensor 80.

Figure 5A:
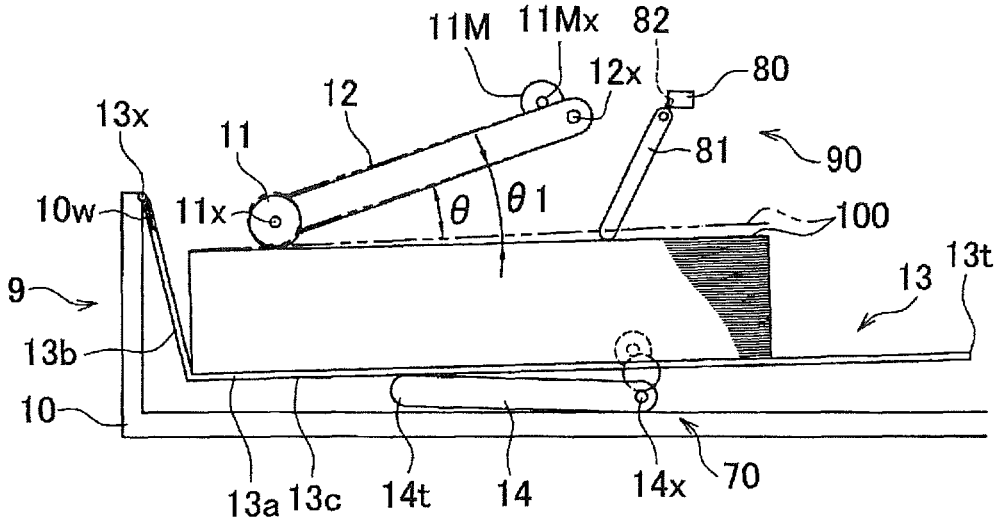
FIGS. 5A and 5B are views for explaining the operations of the presser plate, the arm, the rod member, and the pivot mechanism when the amount of the sheets is decreased in accordance with the recording operation of the printer of FIG. 1, FIG. 5A being a view showing a situation in which the contact angle of the roller is changed from the contact angle in the state of FIG. 4B so as to become slightly larger, FIG. 5B being a view showing a situation of a near empty state.

In the case where the signal indicative of detection of the leading end of the sheet 100 is not output to the controller 60 from the sheet sensor 20*s* even when the predetermined time elapses after the time point of starting of conveyance of the sheet 100 in the recording operation, the second pivotal-movement control circuit 60*b* of the controller 60 determines that the sheet 100 is suffering from the conveyance failure arising from the high resistance portion of the curved path R1. When the sheet 100 suffers from the conveyance failure, the second pivotal-movement control circuit 60*b* drives the pivotal-movement motor 70M and controls the postures of the push-up member 14 and the presser plate 13 based on the detection signal from the sheet sensor 20*s* indicative of the presence or absence of the sheet 100, such that the contact angle θ of the roller 11 becomes slightly larger than the angle in the current state, as shown in FIG. 5A. That is, the second pivotal-movement control circuit 60*b* controls the pivotal-movement motor 70M such that the contact angle θ of the roller 11 in the current state indicated by the long dashed double-short dashed line in FIG. 5A is changed to an angle θ1 indicated by the solid line in FIG. 5A so as to make the contact angle in next conveyance larger than the contact angle in current conveyance. It is noted that an angle at this time is also stored in the ROM of the controller 60. The angle θ1 is larger than the angle θ in the current state and smaller than the maximum angle θ max. By thus changing the contact angle θ of the roller 11 to the angle θ1 larger than the angle in the current state, the pressing force of the roller 11 applied to the sheet 100 is increased, making it possible to prevent or reduce an occurrence of the conveyance failure of the sheet 100 due to slippage of the roller 11 with respect to the sheet 100 arising from an increase in the conveyance load applied to the sheet 100.

Figure 5B:
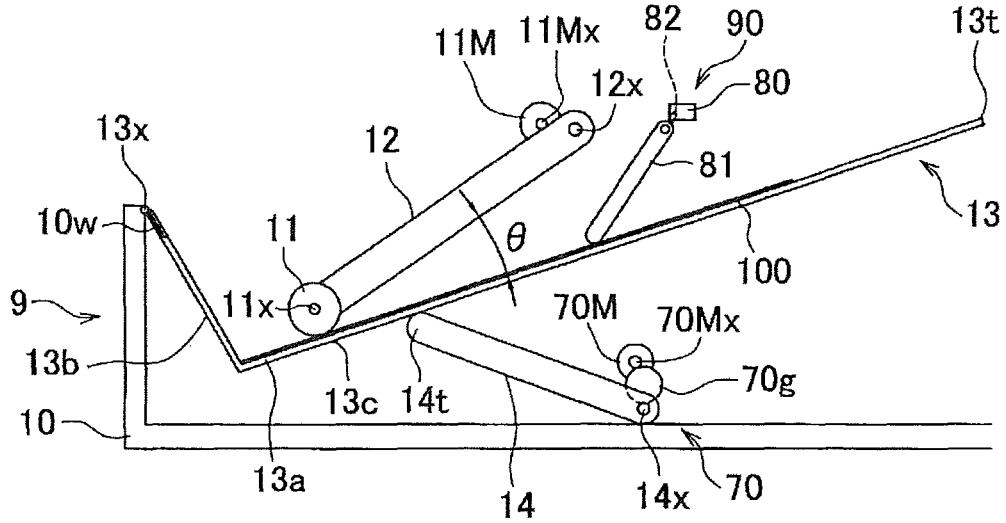

As the recording operation is repeatedly performed thereafter and the sheets 100 are further decreased, the presser plate 13 is pivoted as described above every time the signal indicative of the absence of the protrusion 82 is output from the sensor 80. As a result, even when the state of the sheet supply tray 10 reaches the near empty state, the contact angle θ of the roller 11 is kept at an angle smaller than the maximum angle θ max as shown in FIG. 5B. It is thus possible to smoothly convey one sheet 100 on the sheet supply tray 10.

According to the printer 1 of the present embodiment, the contact angle θ is kept less than the maximum angle θ max described above in the time period from the fully loaded state to the near empty state. When the contact angle θ increases up to the maximum angle θ max, the pressing force of the roller 11 with respect to the sheet 100 becomes large, so that a plurality of the sheets 100 are conveyed at one time from the sheet supply tray 10. That is, the multiple feeding of the sheets 100 is likely to occur. In the present embodiment, however, the contact angle θ is less than the maximum angle θ max. Accordingly, the pressing force of the roller 11 with respect to the sheet 100 is smaller than that when the contact angle is equal to the maximum angle θ max, enabling an occurrence of the multiple feeding to be prevented or reduced.

The pivot mechanism 70 pivots the presser plate 13 such that the contact angle θ is kept not less than the minimum angle θ min in the time period from the fully loaded state to the near empty state, the minimum angle θ min being the contact angle in the fully loaded state. This configuration prevents or reduces an occurrence of the feeding failure described above.

According to the printer 1 of the present embodiment, the separation wall 10*w* is formed integrally with the presser plate 13, so that the separation wall 10*w* is pivotable with the presser plate 13. In this configuration, the angle of the sheet 100 with respect to the separation wall 10*w* when the sheet 100 is conveyed is made constant, stabilizing the separating function of the sheets 100 by the separation wall 10*w*. As a result, the multiple feeding of the sheets 100 can be prevented or reduced with high stability.

According to the printer 1 of the present embodiment, the pivot shaft 13*x* of the presser plate 13 is disposed at the height level equal to or higher than the height level of the upper end of the separation wall 10*w*, and the push-up member 14 pushes up a portion of the lower surface 13*c* of the presser plate 13 located upstream of the rotation shaft 11*x* of the roller 11 in the conveyance direction. In this configuration, even when a rotational force by which the presser plate 13 rotates in a direction away from the roller 11, namely, a clockwise rotational force in FIG. 1, acts on the presser plate 13 due to a contact of the sheet 100 conveyed by the roller 11 with the separation wall 10*w*, the push-up member 14 prevents the presser plate 13 to be rotated. Thus, the presser plate 13 is supported with high stability.

The printer 1 of the present embodiment is provided with the sheet detecting mechanism 90, and the presser plate 13 is controlled by the controller 60 (the first pivotal-movement control circuit 60*a*) so as to get closer to the roller 11 in accordance with the decrease of the sheets 100. Thus, this configuration enables the contact angle θ of the roller 11 to be kept appropriate in accordance with the decrease of the sheets 100.

As a modification, the presser plate 13 may be configured as follows. That is, when the presser plate 13 is pivoted counterclockwise in FIG. 1 about the pivot shaft 13*x* and an upstream end of the presser plate 13 in the conveyance direction comes into contact with the output tray 50, an upstream portion of the presser plate 13 in the conveyance direction is bendable. The bendable configuration of the presser plate 13 may include a configuration in which the upstream portion of the presser plate 13 is formed of an elastic member such as rubber or a configuration in which the presser plate 13 is bendable by use of a hinge and a spring. The configuration in which the upstream portion of the presser plate 13 is bendable enables the length of the presser plate 13 in the conveyance direction to be relatively long. Further, the bendable configuration of the presser plate 13 prevents the presser plate 13 from failing to pivot due to the contact of the upstream end of the presser plate 13 and the output tray 50. Moreover, this configuration eliminates a need of locating the output tray 50 at a higher position for preventing the presser plate 13 from coming into contact with the output tray 50, making it possible to avoid an increase in the size of the printer 1 in the height direction.

While the embodiment of the disclosure has been described, it is to be understood that the present disclosure is not limited to the details of the illustrated embodiment, but may be embodied with various changes and modifications, which may occur to those skilled in the art. For instance, the contact angle θ of the roller 11 when the sheet is conveyed may be smaller than the minimum angle θ min as long as the contact angle θ is smaller than the maximum angle θ max. This configuration also prevents or reduces an occurrence of the multiple feeding of the sheets 100. The pivot shaft 13*x* needs to be located downstream of the rotation shaft 11*x* of the roller 11 in the conveyance direction and may be disposed at a height level lower than the separation wall 10*w*.

The pivot mechanism 70 need not necessarily include the push-up member 14. In this instance, the gear 70*g* or a gear train (not shown) meshing with the shaft 70Mx of the pivotal-movement motor 70M may be brought into mesh with the pivot shaft 13*x*, and the presser plate 13 may be pivoted into a desired posture by driving the pivotal-movement motor 70M. In this instance, the pivotal-movement motor 70M and the gear 70*g* or the gear train constitute the pivot mechanism.

The sheet detecting mechanism may be constituted by a rotary encoder for detecting a rotation angle of the arm 12. In this instance, the controller 60 may be configured to estimate a decrease amount of the sheets 100 and to control the pivotal movement of the presser plate 13, based on the rotation angle detected by the rotary encoder. The sheet detecting mechanism may be constituted by a sensor configured to be capable of detecting a height level of the surface of the uppermost sheet 100 by the sensor alone. In this instance, the sensor is desirably configured to detect the height level of the surface of the uppermost sheet 100 between the intersection point G and the upstream end of the sheet 100 in the conveyance direction. The sheet detecting mechanism 90 may be configured to detect the sheets 100 on a downstream side of the intersection point G in the conveyance direction.

The separation wall 10*w* may be omitted. The sheet detecting sensor 20*s* may be omitted. It is not necessarily required to control the pivot mechanism 70 such that the contact angle θ of the roller 11 becomes larger than that in the current conveyance even if the conveyance failure occurs.

The recording portion 30 may be an ink-jet type, a thermal type, or a laser type. The sheet conveying apparatus according to the present disclosure is not limited to the printer, but may be a facsimile, a copying machine, or a multi-function peripheral (MFP), for instance. The sheet conveying apparatus does not necessarily have to include the recording portion. The sheet is not limited to paper, but may be a cloth, for instance.

What is claimed is:

1. A sheet conveying apparatus, comprising:

a storage portion for storing a stack of a plurality of sheets;

a roller rotatable about a rotation axis parallel to the plurality of sheets stored in the storage portion and configured to convey the plurality of sheets in a conveyance direction by rotating about the rotation axis while being held in contact with a surface of an uppermost one of the plurality of sheets stored in the storage portion;

an arm rotatably supporting the roller, the arm being pivotable about an arm pivot axis parallel to the rotation axis with the roller located downstream of the arm pivot axis in the conveyance direction;

a presser plate pivotable about a presser-plate pivot axis parallel to the rotation axis and configured to press the plurality of sheets stored in the storage portion toward the roller, the presser-plate pivot axis being located downstream, in the conveyance direction, of the rotation axis of the roller in a maximally loaded state in which a maximal amount of the plurality of sheets are loaded on the storage portion; and a pivot mechanism configured to pivot the presser plate about the presser-plate pivot axis, wherein the pivot mechanism is configured to pivot the presser plate such that a contact angle, which is an angle defined upstream in the conveyance direction by the arm and an uppermost one of the plurality of sheets that is held in contact with the roller, is less than a maximum angle in a time period from the maximally loaded state to a minimally loaded state in which a minimal amount of the plurality of sheets are loaded on the storage portion, the maximum angle being an angle defined upstream in the conveyance direction by: only one sheet assumed to be placed on the presser plate which is the presser plate in the maximally loaded state; and the arm the roller of which contacts the one sheet, and wherein a separation wall is formed integrally with a portion of the presser plate located downstream of the roller in the conveyance direction, the separation wall being configured such that, when the plurality of sheets are conveyed by rotation of the roller, the separation wall comes into contact with one of the plurality of sheets that is farthest from the roller and gives a resistance to the one of the plurality of sheets, so as to separate the plurality of sheets.

2. The sheet conveying apparatus according to claim 1, wherein the pivot mechanism is configured such that the contact angle in the time period from the maximally loaded state to the minimally loaded state is not less than a minimum angle which is the contact angle when the storage portion is in the maximally loaded state.

3. The sheet conveying apparatus according to claim 1, wherein the presser-plate pivot axis is disposed at a height level equal to or higher than a height level of an upper end of the separation wall, and wherein the pivot mechanism includes a push-up member configured to push up at least a portion of one surface of the presser plate opposite to another surface thereof facing the roller, the portion being located upstream in the conveyance direction of the rotation axis of the roller in the minimally loaded state, so as to support the presser plate.

4. The sheet conveying apparatus according to claim 3, wherein the presser plate includes a support surface on which the plurality of sheets are placed, and wherein the push-up member is configured to push up the presser plate such that an upstream end of the presser plate in the conveyance direction is located at a height level higher than a downstream end thereof in the conveyance direction.

5. A sheet conveying apparatus, comprising:

a storage portion for storing a stack of a plurality of sheets;

a roller rotatable about a rotation axis parallel to the plurality of sheets stored in the storage portion and configured to convey the plurality of sheets in a conveyance direction by rotating about the rotation axis while being held in contact with a surface of an uppermost one of the plurality of sheets stored in the storage portion;

an arm rotatably supporting the roller, the arm being pivotable about an arm pivot axis parallel to the rotation axis with the roller located downstream of the arm pivot axis in the conveyance direction;

a presser plate pivotable about a presser-plate pivot axis parallel to the rotation axis and configured to press the plurality of sheets stored in the storage portion toward the roller, the presser-plate pivot axis being located downstream, in the conveyance direction, of the rotation axis of the roller in a maximally loaded state in which a maximal amount of the plurality of sheets are loaded on the storage portion; and a pivot mechanism configured to pivot the presser plate about the presser-plate pivot axis, wherein the pivot mechanism is configured to pivot the presser plate such that a contact angle, which is an angle defined upstream in the conveyance direction by the arm and an uppermost one of the plurality of sheets that is held in contact with the roller, is less than a maximum angle in a time period from the maximally loaded state to a minimally loaded state in which a minimal amount of the plurality of sheets are loaded on the storage portion, the maximum angle being an angle defined upstream in the conveyance direction by: only one sheet assumed to be placed on the presser plate which is the presser plate in the maximally loaded state; and the arm the roller of which contacts the one sheet, and wherein the sheet conveying apparatus further comprises:

a sheet detecting mechanism configured to detect a decrease of the plurality of sheets stored in the storage portion; and a first pivotal-movement controller configured to control the pivot mechanism such that the presser plate gets closer to the roller in response to detection of the decrease of the plurality of sheets by the sheet detecting mechanism.

6. The sheet conveying apparatus according to claim 5, wherein the sheet detecting mechanism is configured to detect the decrease of the plurality of sheets stored in the storage portion on an upstream side in the conveyance direction of an intersection point of: the presser plate in a state in which an angle, which is defined upstream in the conveyance direction by the arm and the presser plate when the roller contacts the presser plate in an empty state in which no sheets are stored in the storage portion, is the same as the contact angle in the maximally loaded state; and a virtual line that indicates a height level of an uppermost one of the plurality of sheets that is held in contact with the roller in the maximally loaded state.

7. A sheet conveying apparatus, comprising:

a storage portion for storing a stack of a plurality of sheets;

a roller rotatable about a rotation axis parallel to the plurality of sheets stored in the storage portion and configured to convey the plurality of sheets in a conveyance direction by rotating about the rotation axis while being held in contact with a surface of an uppermost one of the plurality of sheets stored in the storage portion;

an arm rotatably supporting the roller, the arm being pivotable about an arm pivot axis parallel to the rotation axis with the roller located downstream of the arm pivot axis in the conveyance direction;

a presser plate pivotable about a presser-plate pivot axis parallel to the rotation axis and configured to press the plurality of sheets stored in the storage portion toward the roller, the presser-plate pivot axis being located downstream, in the conveyance direction, of the rotation axis of the roller in a maximally loaded state in which a maximal amount of the plurality of sheets are loaded on the storage portion; and a pivot mechanism configured to pivot the presser plate about the presser-plate pivot axis, wherein the pivot mechanism is configured to pivot the presser plate such that a contact angle, which is an angle defined upstream in the conveyance direction by the arm and an uppermost one of the plurality of sheets that is held in contact with the roller, is less than a maximum angle in a time period from the maximally loaded state to a minimally loaded state in which a minimal amount of the plurality of sheets are loaded on the storage portion, the maximum angle being an angle defined upstream in the conveyance direction by: only one sheet assumed to be placed on the presser plate which is the presser plate in the maximally loaded state; and the arm the roller of which contacts the one sheet, and wherein the sheet conveying apparatus further comprises:

a sheet detecting sensor configured to detect a sheet as one of the plurality of sheets conveyed by the roller; and a second pivotal-movement controller configured to control the pivot mechanism such that the contact angle in next conveyance is larger than the contact angle in current conveyance when it is determined that a conveyance failure of the sheet is occurring based on a detection signal from the sheet detecting sensor indicative of a presence or an absence of the sheet.

* * * * *